US005627560A

United States Patent [19]

Verhulst

[11] Patent Number: 5,627,560

[45] Date of Patent: May 6, 1997

[54] DISPLAY DEVICE

[75] Inventor: Antonius G. H. Verhulst, Eindhoven, Netherlands

[73] Assignee: U.S. Philips Corporation, New York, N.Y.

[21] Appl. No.: 470,893

[22] Filed: Jun. 6, 1995

[30] Foreign Application Priority Data

Jun. 9, 1994 [EP] European Pat. Off. ..... 94201651

[51] Int. Cl.[6] ..... G09G 3/36

[52] U.S. Cl. ..... 345/97; 345/100; 345/94

[58] Field of Search ..... 345/92, 90, 89, 345/87, 94, 97, 95, 96, 99, 98, 100, 103, 208, 209, 210; 359/55, 56; 348/790, 791, 792, 793; H04N 3/14, 9/30

[56] References Cited

U.S. PATENT DOCUMENTS

| | | | |
|---|---|---|---|
| 4,455,576 | 6/1984 | Hoshi | 348/792 |
| 4,840,462 | 6/1989 | Hartmann | 345/89 |
| 4,973,135 | 11/1990 | Okada et al. | 350/334 |
| 4,976,515 | 12/1990 | Hartmann | 345/89 |

*Primary Examiner*—Xiao Wu
*Attorney, Agent, or Firm*—Robert J. Kraus

[57] ABSTRACT

In a ferro-electric liquid crystal display, in which the pixels in one row first receive a reset or "blanking" signal, this reset signal is presented by providing the counter electrode, prior to selection, with a reset voltage while simultaneously selecting the row of pixels to be reset. When a single counter electrode is used, it switches to a reset voltage during each selection period. If the counter electrode is divided into sub-strips, these strips switch to a reset voltage once per picture period.

4 Claims, 3 Drawing Sheets

DISPLAY DEVICE

BACKGROUND OF THE INVENTION

The invention relates to a display device comprising a first substrate having a group of row or selection electrodes and a group of column or data electrodes and a matrix of picture electrodes arranged in rows and columns at a location of ferro-electric liquid crystal display elements between the first substrate and a second substrate provided with a counter electrode, each display element being connected to a column electrode via an active switching element and a display device comprising means for bringing, prior to selection, a row of display elements to an extreme optical transmission state by means of an auxiliary signal.

An extreme optical transmission state is herein understood to mean such a state that the pixel is substantially entirely or maximally transmissive or non-transmissive. This state is also determined by the type of ferro-electric liquid crystal material used (ferroelectric, anti-ferro-electric) and, for example the position of possible polarizers.

Such display devices, notably equipped with ferro-electric liquid crystal material are used, for example in television apparatus or in apparatus for non-volatile display. Advantages are the high switching rate of ferro-electric liquid crystal materials and their minor dependence on the viewing angle.

A display device of the type mentioned in the opening paragraph is described in U.S. Pat. No. 4,976,515. Prior to selection, the display elements, or pixels, are brought to an extreme state by means of the auxiliary signal To be able to use rapidly switching ferro-electric liquid crystal materials, the rows of pixels within a row selection period are first brought to the extreme state, (for example, the fully transmissive state) by means of the auxiliary signal (blanking) and subsequently they are selected while information to be displayed is presented simultaneously. When slower materials are used, the auxiliary signal or blanking signal may alternatively be supplied one or more row selection periods in advance, as described in U.S. Pat. No. 4,840,462.

Thin-film transistors (TFTs) are used as switches in said display devices. Via a column electrode, which is connected in an electrically conducting manner to the source zone of the transistor, and the drain zone of the transistor, the auxiliary signal is applied between a picture electrode connected in an electrically conducting manner to the drain zone and a common counter electrode. Ferro-electric liquid crystal material is present between the common counter electrode and the picture electrodes. The voltage at the picture electrode, hence at the column electrode, should have a sufficient amplitude to fully bring a pixel to its extreme transmission state.

While information is being written, the column electrode is subsequently provided with the suitable voltage. If the pixel must be brought to a state which is practically equal to the other (non-transmissive) extreme state, it must be possible for the voltage at the column electrodes to vary within a large range, for example from −7 V to +6 V, dependent on the liquid crystal materials used and the properties of the transistors. For most column drive circuits such a voltage swing cannot be realized or can only be realized at a very high cost.

SUMMARY OF THE INVENTION

It is, inter alia an object of the invention to eliminate the above-mentioned drawbacks as much as possible.

To this end, a display device according to the invention is characterized in that the display device comprises a drive circuit for alternately presenting a voltage for the auxiliary signal and a voltage for selection to a counter electrode arranged on the second substrate.

Since the blanking signal is now presented via another (part of the) drive circuit than the data signal (column signal), lower voltages can be used in these (parts of) drive circuits than in the case where both signals are presented via the same path. Consequently, simpler and lower cost circuits are sufficient, while they have also a lower energy consumption.

Another embodiment according to the invention is characterized in that the second substrate is provided with electrode strips extending in the row direction which, together with rows of picture electrodes located opposite the electrode strip and intermediate ferro-electric liquid crystal material form part of rows of display elements, the display device comprising a drive circuit for alternately presenting a voltage for the auxiliary signal and a voltage for selection to the electrode strips.

Since the second substrate is now provided with electrode strips extending in the row direction, which with a row of picture electrodes located opposite the electrode strips and intermediate ferro-electro-optical material form part of a row of display elements, rows of display elements can be separately brought to the extreme state via a voltage at the associated electrode strip without this way of blanking via the second substrate influencing the functioning of other rows of pixels.

An embodiment of a display device according to the invention is characterized in that the drive circuit comprises means for presenting the auxiliary signal to a first row of display elements during a part of a line period and for presenting a selection signal to a second row of display elements during at least a portion of the other part of the line period.

This embodiment has the advantage that the distance in time between the presentation of the auxiliary signal and the selection of the row of pixels for writing information can be chosen to be sufficiently long to bring the pixels to their extreme transmission state.

When rapidly switching materials are used, a device can be used to advantage, in which the drive circuit comprises means for presenting the auxiliary signal to a first row of display elements during a part of a line period and for presenting a selection signal to the same row of display elements during at least a portion of the other part of the line period.

BRIEF DESCRIPTION OF THE DRAWINGS

These and other aspects of the invention will be apparent from and elucidated with reference to the embodiments described hereinafter.

In the drawing:

FIG. 2 is a diagrammatic plan view of a part of a display device according to the invention, while

DESCRIPTION OF THE PREFERRED EMBODIMENTS

Figure 1:
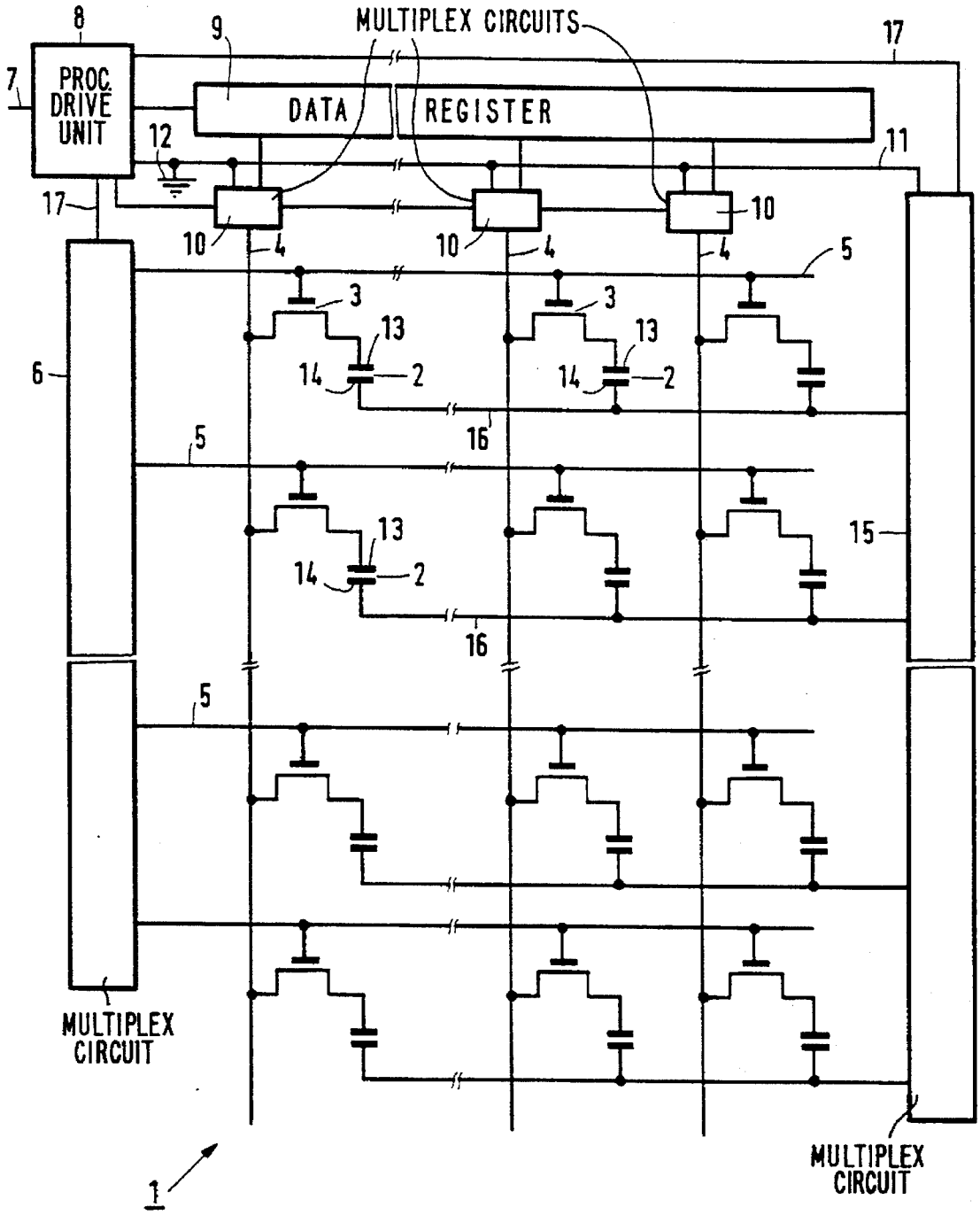
FIG. 1 shows diagrammatically an electrical equivalent circuit diagram of a display device according to the invention.

FIG. 1 shows diagrammatically an electrical equivalent circuit diagram of a display device 1 according to the invention. This device comprises a matrix of pixels 2 arranged in rows and columns. The pixels 2 are connected to column or data electrodes 4 via three-pole switches, in this example MOS-TFT transistors 3. A row of pixels is selected via row or selection electrodes 5 which select the relevant row via the gate electrodes of the TFTs. The row electrodes 5 are consecutively selected by means of a multiplex circuit 6.

Incoming (video) information 7 is stored in a data register 9 after it may have been processed in a processing/drive unit 8. Multiplex circuits 10, which are driven by the drive unit 8 in such a way that either the signals presented by the data register 9 are presented to the column electrodes or a (virtual) earth voltage symbolically denoted by the earth symbol 12 is presented via the line 11, are arranged between the data register 9 and the column electrodes 4. The voltages presented by the, data register 9 are chosen to be positive in this embodiment and cover a voltage range which is sufficient to set the desired scale of grey levels. The pixels 2, here represented by means of capacitors, are then positively charged via the TFTs 3 in that the picture electrodes 13 take over the voltage of the column electrodes during selection, while the picture electrodes 14 are connected to earth. The picture electrodes 14 may be implemented as a common counter electrode, but alternatively they may be divided into strips.

As described in U.S. Pat. No. 4,976,515, the display elements, or pixels, are brought to an extreme state by means of an auxiliary signal, prior to selection. To this end the device according to the invention comprises a second multiplex circuit 15 which gives the picture electrode(s) 14 a (virtual) earth voltage during selection (upon division into strips 16 by means of the lines (electrodes) 16), but provides them with a positive voltage during nonselection. Simultaneously when the positive voltage is presented, an earth voltage is presented to the column electrodes via the multiplexers 10, while the relevant row electrode 5 is selected via multiplex circuit 6 so that the pixel is charged negatively. The negative voltage is sufficient to bring the pixels to the ,desired extreme state. In this respect, such a voltage is chosen as the virtual earth voltage that, in respect thereto, the voltages supplied by the data register 9 are positive and the voltages supplied by the circuit 15 are positive. The drive unit 8 ensures the mutual drive and synchronization, inter alia via drive lines 17. In contrast to the device described in U.S. Pat. No. 4,976,515, the multiplexers 10 only need to supply voltages between, for example 0 V and +6 V instead of between −7 V and +6 V, while the circuit 15 only needs to supply voltages between 0 V and +7 V.

Figure 2:
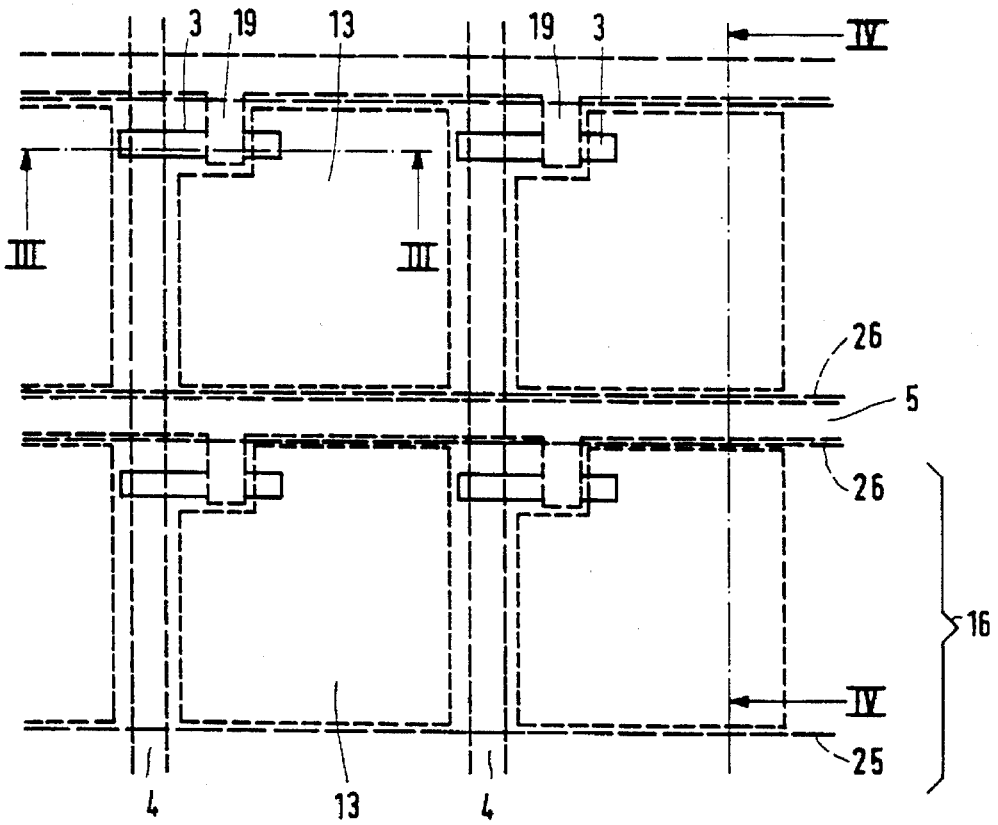
Figure 3:
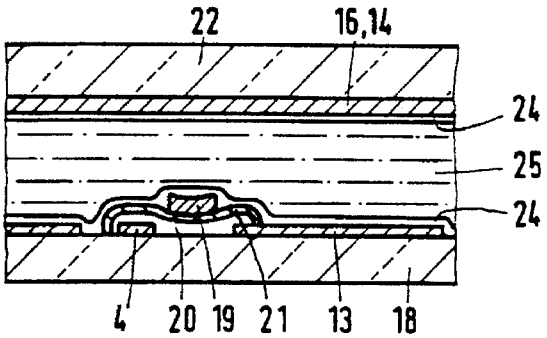
FIGS. 3 and 4 show cross-sections taken on the lines III—III and IV—IV in FIG. 2.
Figure 4:
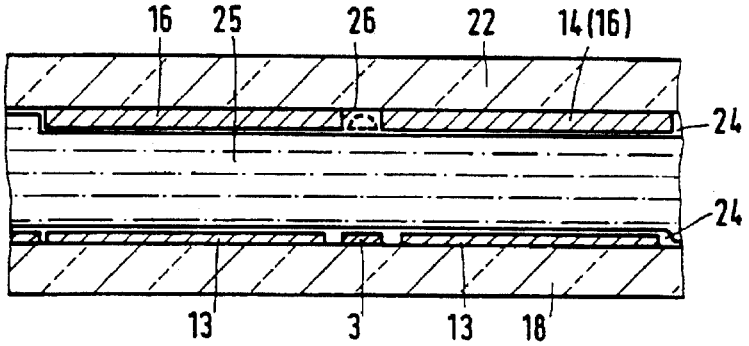

FIG. 2 is a diagrammatic plan view of a part of a display device according to the invention, while FIGS. 3 and 4 show cross-sections taken on the lines III—III and IV—IV In FIG. 2.

Column electrodes 4 and picture electrodes 13, in this example of a transparent conducting material, for example indium-tin oxide are present on a first substrate 18. The first substrate 18 is provided with row electrodes 5 having branches 19 at the location of TFT transistors 3, which branches also function as gate electrodes for the TFTs. In this embodiment, these TFTs are implemented as MOS transistors which consist of a layer of amorphous silicon 20 which is patterned and provided with source and drain zones (not shown). The column electrodes 4 function as contacts for the source zones, while the picture electrodes 13 serve as contacts for the drain zones. A thin layer of gate oxide is present between the gate electrodes 19 and the amorphous silicon. At the location of crossings of the row and column electrodes, these electrodes are mutually insulated by means of an insulating material, for example oxide.

A second substrate 22 is provided with picture electrodes 14 integrated to form one counter electrode. Moreover, the two substrates are coated with oftenting layers 24, while a ferro-electric liquid crystal material 25 is present between the substrates. Possible spacers and the sealing edge, as well as polarizers and possible other conventional components are not shown.

The counter electrode may alternatively be divided into strip-shaped rows 16, shown diagrammatically by means of broken lines 26 in FIGS. 2 and 4.

Figure 5:
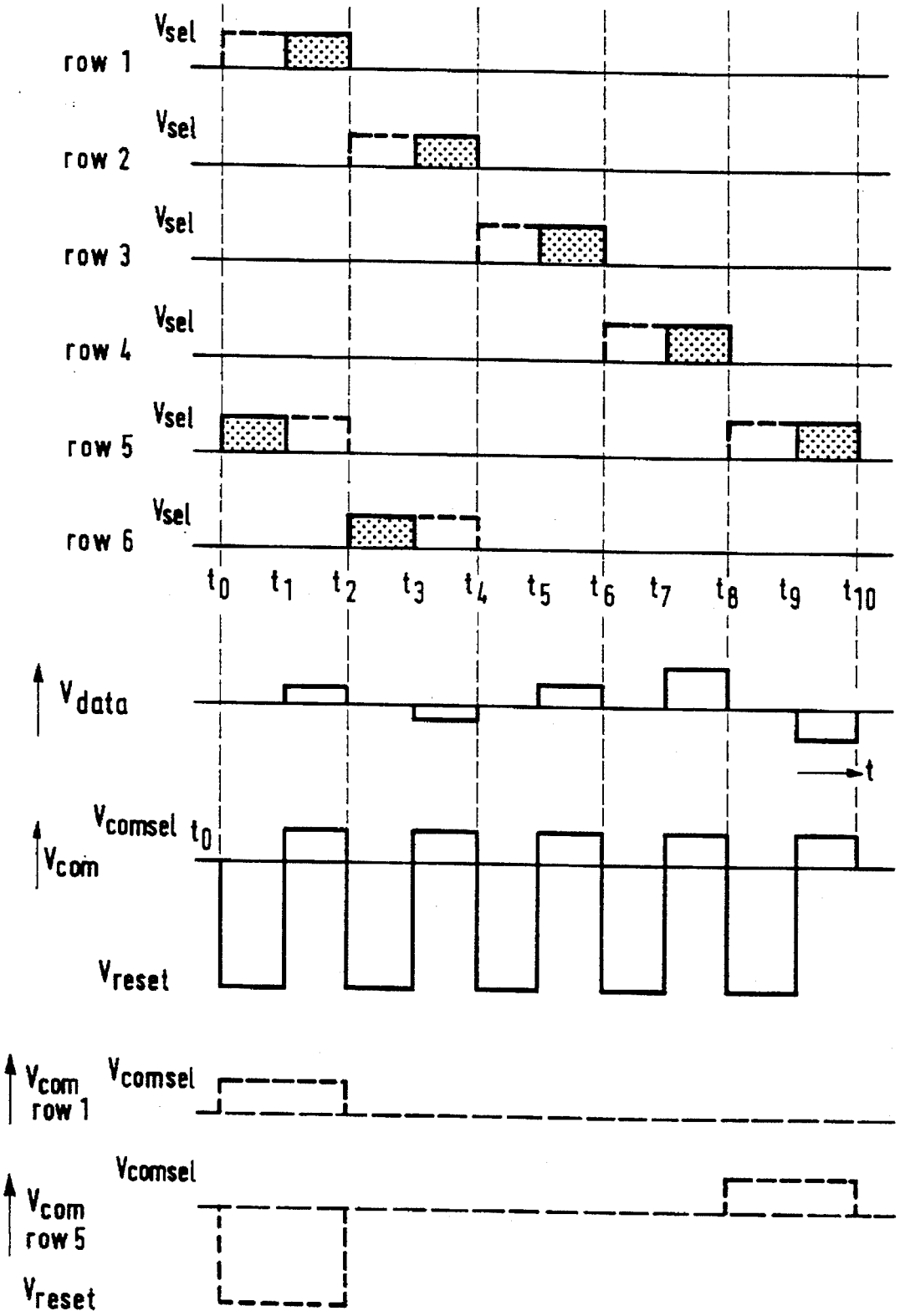
FIG. 5 shows the voltage variation across a number of electrodes during use of such a device.

FIG. 5 shows diagrammatically the variation of the voltages at various row electrodes (row 1–row 5), at one of the column electrodes ($V_{data}$) mad at the counter electrode 14, if this electrode is implemented as a common counter electrode ($V_{com}$). During the interval $t_0$–$t_1$ a selection voltage $V_{sel}$ is presented to the row electrode "row 5", with which the TFTs are rendered conducting, while a reset voltage $V_{res}$ is presented to the counter electrode. The voltage difference ($V_{res}$–$V_{data}$), in which $V_{data}$=0 V is sufficient to bring the associated row of pixels to an extreme transmissive state ("blanking") before this row is selected from $t_9$ with a selection voltage $V_{sel}$ again, while data voltages ($V_{data}$) are presented to the column electrodes. A possible loss of voltage: across the transistor has not been taken into account.

During the interval $t_1$–$t_2$, a selection voltage $V_{sel}$ is presented to the row electrode "row 1" while a voltage $V_{data}$ is presented to the column electrode. During this interval, the voltage $V_{com}$ at the counter electrode has the value $V_{comsel}$. The voltage difference ($V_{comsel}$–$V_{data}$) brings the selected pixel in "row 1" to the desired transmissive state. During the interval $t_2$–$t_3$ the pixels of "row 6" are brought to the extreme transmissive state in a similar manner, and subsequently the pixels of "row 2" are brought to the desired transmissive state, and so forth.

If the counter electrodes are implemented as strip-shaped electrodes, the reset voltage is only applied to the electrodes 14, 16 associated with the pixels of "row 5" via the circuit 15 during the interval $t_0$–$t_1$ and subsequently (for example, during $t_1$–$t_2$ or even until the next cycle) the voltage $V_{com}$ at the counter electrodes 14, 16 will become equal to the value $V_{comsel}$. Likewise, the reset voltage is applied only to the electrodes associated with the pixels of "row 6" via the circuit 15 during the interval $t_2$–$t_3$, mad subsequently the voltage $V_{com}$ at the counter electrode will become equal to the value $V_{comsel}$.

Since only the pixels of one row are provided with a voltage at the counter electrodes 14, 16, this voltage does not influence the pixels of other rows (less crosstalk). An additional advantage is that both the selection voltage and the reset voltage can now be presented throughout the interval $t_0$–$t_2$; the reset voltage should then have a sufficient amplitude to realize a full reset. This is illustrated by means of broken lines in FIG. 5.

The invention is of course not limited to the embodiment shown, but many variations within the scope of the invention can be realized by those skilled in the art. For example, the display device may be implemented as a reflective display device. The distance in time between the reset pulse and the actual selection pulse for a row need not last as long as in the embodiment described. When very rapidly switching ferro-electric liquid crystal materials are used, the reset voltage may be presented during the interval $t_0$–$t_1$ and the selection voltage for the same row can be presented during the interval $t_1$–$t_2$ for example in video applications in which the period $t_0$–$t_2$ corresponds to a line period.

Moreover, the pixels may be provided with storage capacitances.

The functions of the circuits 10 and the data register 9 may also be integrated in one circuit which may supply bipolar signals to the column electrodes during selection (for the purpose of crosstalk compensation).

In summary, the invention provides the possibility of bringing a row of pixels, prior to selection, to a complete on or off-state (reset) via a voltage pulse at the (possibly structured) counter electrode 14 (16), so that it is possible to work with lower voltages.

I claim:

1. display device comprising a first substrate having a group of selection electrodes and a group of data electrodes and a matrix of picture electrodes arranged in rows and columns at the locations of ferro-electric liquid crystal display elements between the first substrate and a second substrate provided with a counter electrode, each display element being connected to a data electrode via an active switching element and the display device comprising means for bringing, prior to selection, a row of display elements to an extreme optical transmission state by means of an auxiliary signal, characterized in that the display device comprises a drive circuit for alternately applying the auxiliary signal and a data-offset voltage ($V_{comsel}$) to the counter electrode on the second substrate, said data-offset voltage being applied to said counter electrode during the application of a data voltage to one of said data electrodes.

2. A display device comprising a first substrate having a group of selection electrodes and a group of data electrodes and a matrix of ferro-electro-optical display elements arranged in rows and columns between the first and a second substrate, each having a picture electrode on the first substrate, which picture electrode is connected to a data electrode via an active switching element, the display device comprising means for bringing, prior to selection, a row of display elements to an extreme optical transmission state by means of an auxiliary signal, characterized in that the second substrate is provided with electrode strips extending in the row direction which, together with rows of picture electrodes located opposite the electrode strips and intermediate ferro-electric liquid crystal material form part of rows of display elements, the display device comprising a drive circuit for alternately applying the auxiliary signal and a data-offset voltage ($V_{comsel}$) to the electrode strips, said data-offset voltage being applied to one of said electrode strips during the application of a data voltage to one of said data electrodes.

3. A display device as claimed in claim 1 or 2, characterized in that the drive circuit comprises means for presenting the auxiliary signal to a first row of display elements during a part of a line period and for presenting the data-offset voltage to a second row of display elements during at least a portion of the other part of the line period.

4. A display device as claimed in claim 1 or 2, characterized in that the drive circuit comprises means for presenting the auxiliary signal to a first row of display elements during a part of a line period and for presenting the data-offset voltage to the same row of display elements during at least a portion of the other part of the line period.

* * * * *